United States Patent [19]

Beutler et al.

[11] Patent Number: 4,668,171

[45] Date of Patent: May 26, 1987

[54] TORQUE CONTROL DEVICE FOR AN ADJUSTABLE HYDROPUMP

[75] Inventors: Gerhard Beutler, Nagold; Heinz Berthold, Horb, both of Fed. Rep. of Germany

[73] Assignee: Brueninghaus Hydraulik GmbH, Horb, Fed. Rep. of Germany

[21] Appl. No.: 681,920

[22] Filed: Dec. 14, 1984

[30] Foreign Application Priority Data

Dec. 14, 1983 [DE] Fed. Rep. of Germany ..... 3345264

[51] Int. Cl.[4] ..... F04B 49/00; F04B 1/26

[52] U.S. Cl. ..... 417/213; 417/218; 417/222

[58] Field of Search ..... 417/213, 218–222; 60/450, 451

[56] References Cited

U.S. PATENT DOCUMENTS

| | | | |
|---|---|---|---|
| 3,635,021 | 1/1972 | McMillen et al. | 417/222 X |
| 3,669,570 | 6/1972 | Himmler | 417/222 |
| 3,768,928 | 10/1973 | Miller et al. | 417/222 X |
| 3,935,707 | 2/1976 | Murphy et al. | 417/218 X |
| 4,132,506 | 1/1979 | Dantlgraber | 417/218 |
| 4,348,159 | 9/1982 | Acheson | 417/220 |

FOREIGN PATENT DOCUMENTS

| | | | |
|---|---|---|---|
| 1388002 | 3/1975 | United Kingdom | 417/218 |

*Primary Examiner*—Carlton R. Croyle
*Assistant Examiner*—Paul F. Neils
*Attorney, Agent, or Firm*—Scully, Scott, Murphy & Presser

[57] ABSTRACT

A torque control device for an adjustable hydropump is described which is based on an output control device in which the output control is determined as a function of the output pressure of the hydropump and a pressure in a working pressure control line. For this purpose a torque valve is provided whose closure power is determined by a measuring spring or set of springs connected with the pump control member and pretensioned depending on the output setting. The torque valve connects the working pressure control line with the pressureless outlet depending on the pressure in the working pressure control line and the pretension of the measuring spring. The torque valve can be fixed on to the hydropump as a separate unit and the control characteristic can be changed from outside by adjustment of the measuring spring.

9 Claims, 5 Drawing Figures

I-I

TORQUE CONTROL DEVICE FOR AN ADJUSTABLE HYDROPUMP

TECHNICAL FIELD OF THE INVENTION

The invention relates to a torque control device for an adjustable hydropump having a hydraulic servomechanism for continuous adjustment of the pump output, in which the output setting is determined by the output pressure of the hydropump and a pressure in a working pressure control line, and in which the adjusting mechanism includes a spring urging the pump control member in the direction of maximum output and at least one piston acting on the pump control member in the direction of a reduction in output, the piston face being exposed to the output pressure or connected with the outlet through a hydraulically operated control valve, and the control valve being operated by the pressure in the working pressure control line.

The object of a torque controller is to maintain the intake torque of a hydropump constant. The relationship that applies is that the product of the working pressure and the stroke volume of the pump must be constant. A measure of the stroke volume of a hydropump is the position of the pump control member that determines the pump output.

BRIEF DESCRIPTION OF THE PRIOR ART

An output control device of the above-mentioned kind which can also be combined with a torque controller is known, for example, from DE-AS 15 28 550.

OBJECT OF THE INVENTION

The object of the invention is to improve an output control device of the above-mentioned kind so that it also provides torque control.

SUMMARY OF THE INVENTION

As a solution of this problem it is proposed to provide in a device of the above-mentioned kind a torque valve whose closure power is determined by a measuring spring or set of springs connected to the pump control member and biassed as a function of the output setting and which connects the working pressure control line with the working control line with the pressureless outlet depending on the pressure in the working pressure control line and the tension in the measuring spring.

Power control devices with torque valves that are acted upon on the one hand by a pre-tensioned measuring spring through the pump control member and on the other hand by a pressure proportional to the working pressure of the pump are known per se from DE-AS 20 38 968. In this known controller, the control of the torque characteristic is through a throttle system by reduction of the working pressure which acts on the torque valve. This leads to considerable losses. Further losses occur because on swinging out the pump, the control means must be forced out from the piston face in the control mechanism via a throttle.

In contrast to this, in the present invention, the control valve which acts as a pressure balance, primarily to control the output, is inserted after the torque valve. This has the advantage that there is no effect on the output setting below the corresponding torque control at the torque valve. A further important advantage of the invention is that short swinging out times (i.e. times to bring the pump up to maximum delivery) become possible since the control piston of the control mechanism can be directly connected to the outlet. Nevertheless a loss-free control results, since in contrast to the known state of the art, namely DE-AS 20 38 968, the torque characteristic is determined not through a throttle system by reduction of the working pressure but solely by change in the spring tension at the torque valve, i.e. by the design of the measuring spring or set of springs.

In a further embodiment of the invention, the construction and arrangement of the torque valve in an output controller according to the invention allows the torque valve to be fixed on to the hydropump as a separate unit and a follower pin of the pump control member engages the torque valve to change the tension of the measuring spring or set of springs as a function of the output setting. Such a torque valve can be used for pumps of different sizes and power provided these pumps conform in the adjusting path of the pump control member, i.e. for example in the pivot angle in the case of adjustable skew-axis pumps. A suitable construction of such a torque valve is characterized in claims 4 and 5.

Since in the device according to the invention the torque characteristic is determined solely by the design of the characteristic of the measuring spring or set of springs, a particularly advantageous form of the invention is when the stop for the measuring spring or set of springs in the torque valve can be adjusted from outside by means of a hand control. By means of the externally adjustable measuring spring or set of springs any desired number of different torque characteristics can be preselected and can also be set or varied during operation, which is also an advantage for getting the best match of the pump torque to the torque of the motor driving the pump. A rapid adjustment to particular applications is made possible.

In a further embodiment, the stop in the torque valve can advantageously be arranged on the face of the valve housing and made releasable for the exchange of measuring springs or sets of springs. In an advantageous further development of the invention the torque control device is also suitable for use as a combined control for two or more hydropumps that are mechanically coupled on the drive side if according to the invention the closure member of the torque valve of each pump is acted on by the sum of the pressure in the working pressure control line of the individual pumps and the pressure in the working pressure line of the other pump or pumps, and if each torque valve connects the working pressure control line of its pump with the pressureless outlet depending on the total working pressure and the pre-tensioning of its measuring spring. For this purpose the closure member of the torque valve has several measuring surfaces which act in parallel and are each exposed to the working pressure of one of the pumps.

BRIEF DESCRIPTION OF THE DRAWINGS

Exemplary embodiments of the invention will now be described in more detail with reference to the accompanying drawings, in which.

DETAILED DESCRIPTION OF THE INVENTION

Figure 1:
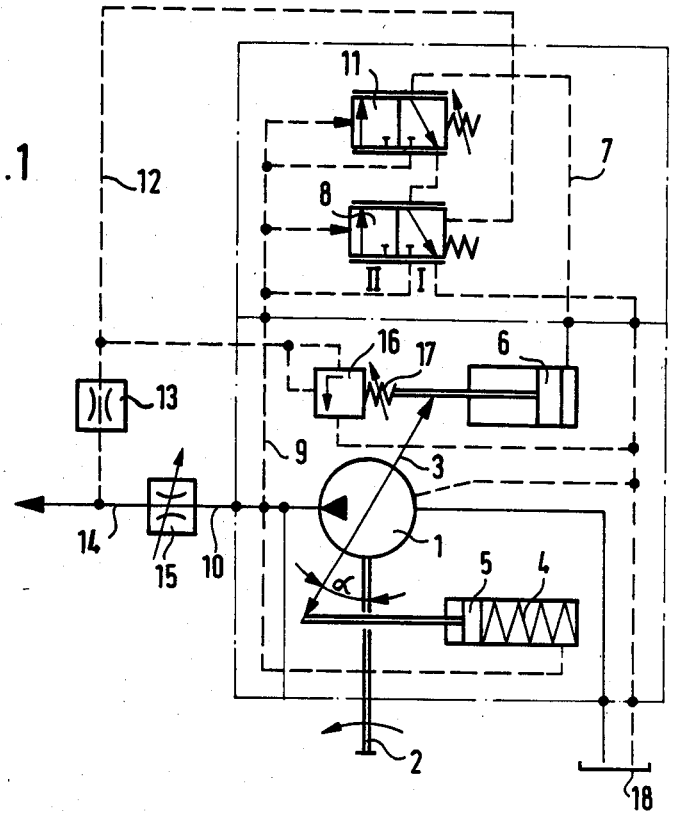
FIG. 1 shows diagrammatically a control device for a hydropump according to the invention.

The hydropump 1 is driven via the shaft 2 by a motor (not shown). If, for example, the hydropump 1 is an adjustable axial piston pump, the pump control member consists of a pivot member 3 whose swing angle $\alpha$ is proportional to the stroke volume of the hydropump 1. The servocontrol mechanism for adjusting the swing angle $\alpha$, which is not shown in detail, includes a spring 4 and an adjusting piston 5 which can be exposed to pressure, in which the spring 4 urges the hydropump 1 in the direction of the maximum angle of swing $\alpha$, that is to say maximum delivery.

An adjusting piston 6 of the control mechanism, which can also be functionally combined with the piston 5, assumes the function of restoration in the direction of a smaller angle of swing $\alpha$. Its piston face is substantially greater than that of the adjusting piston 5. The control pressure in the line 7 acting on the piston 6 is taken via a control valve 8 and the line 9 from the output pressure line 10 of the hydropump 1. In series with the control valve 8 there is a conventional pressure limiting valve 11. The control valve 8 is formed as a pressure balance and is exposed on one side to the output pressure and on the other to a control pressure in the working pressure control line 12, which receives the working pressure of the hydropump 1 from the working pressure line 14 through a throttle 13 that limits the control stream, after an (optionally adjustable) output stream throttle 15.

A torque valve 16 is acted upon on one side by the pressure in the control line 12 and on the other side by a measuring spring or set of springs 17 whose pre-tension is determined by the position of the piston 6 or the pump control member 3. The torque valve 16 can connect the control line 12 with the pressureless outlet or drain 18.

If the working pressure in the control line 12 reaches the value set at the torque valve 16, so that this begins to open to the outlet, there is a fall in pressure at the control sleeve of the control valve 8. The control sleeve is displaced to the control position II and provides control pressure to the piston 6, so that this is urged to move the control member 3 of the hydropump 1 in the direction of reduced output. The measuring spring 17 or the set of measuring springs of the torque valve 16 is thereby pre-tensioned. The measuring spring or set of springs is constructed, in respect of its spring characteristic so that depending on the pre-tensioning a curve envelope results in the theoretically desired power hyperbola. A particular output pressure in the line 10 corresponds to a predetermined angle of swing $\alpha$. The output setting of the hydropump 1 in the region in which the torque control, that is to say the torque valve 16, has not yet responded, takes place in the usual way through the output throttle 15 and requires no special explanation.

Figure 2:
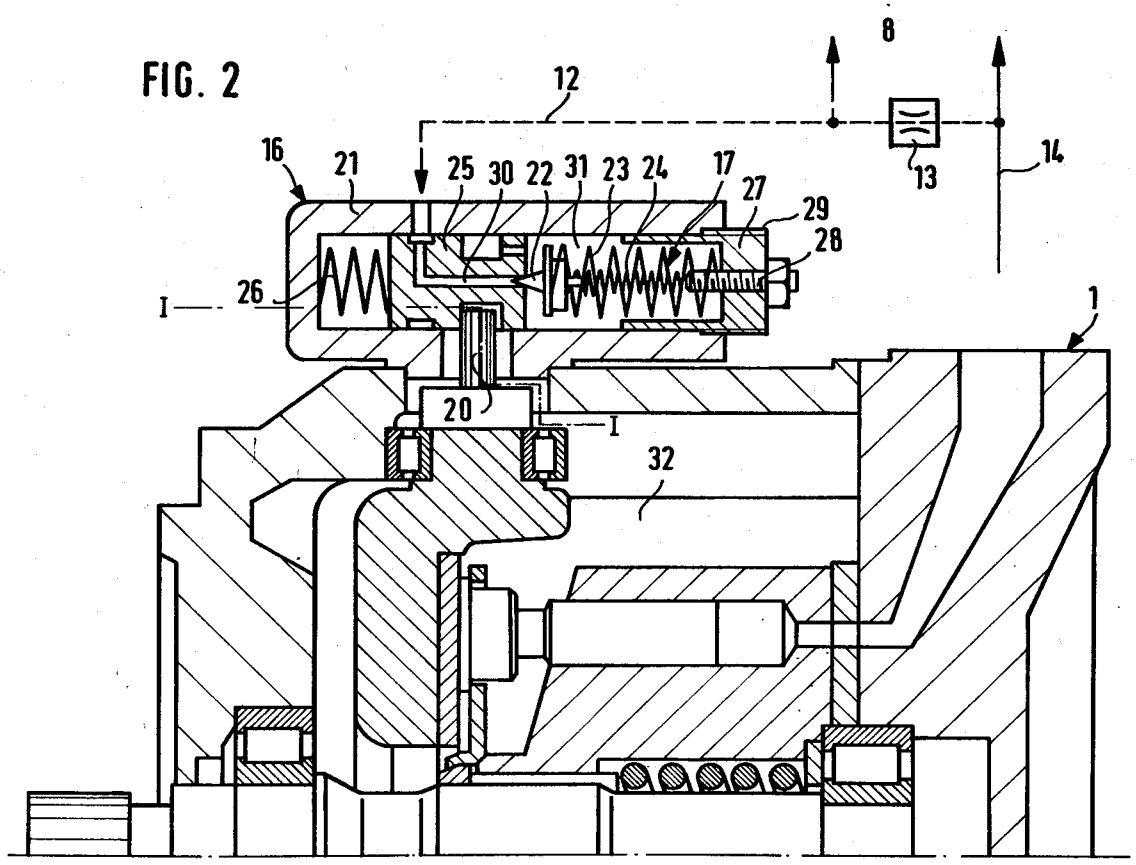
FIG. 2 shows diagrammatically in section and in detail a torque valve according to the invention fitted on to a hydropump.
Figure 5:
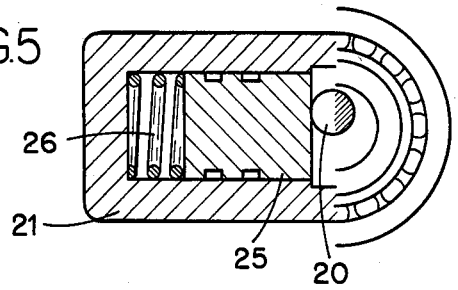

In FIG. 2 one embodiment of a torque valve 16 is shown, connected to the pivotable pump control member of a skew-axis axial piston pump. The pump will not be explained in more detail. The pivotable control member 3, as shown in FIG. 1 has a follower pin 20 which extends into the torque valve 16. The torque valve 16 is designed, in the embodiment shown, as a seat-valve arranged in a valve housing 21 and having as its closure member a valve cone 22 which is acted upon by the set of measuring springs 17 made up of the springs 23 and 24. The valve seat for the valve cone 22 is formed on a valve body 25, arranged displaceably in the valve housing 21 and engaged by the follower pin of the pump control member. The valve body is acted upon by a spring 26 supported in the valve housing 21 and holds the valve body 25 in close engagement with the follower pin 20. The spring 23 of the measuring spring set 17 is supported on a stop 27, and the spring 24 on a setting screw 28 in the stop 27.

The stop 27 is screwed on to the face of the valve housing 21. The tension in the measuring spring set 17 and thus the position of the desired torque characteristic curve and the response point of the torque valve 16 can be adjusted by the rotational position of the stop 27. The stop 27 has a hand control 29 for this purpose. The state of the torque curve or spring characteristic can result from change in the pre-tension of the spring 24 by means of the setting screw 28.

The pressure occurring in the working pressure control line 12 acts on the closure member 22 through the passage 30 in the valve body 25, against the force of the measuring spring set 17. The width of the valve seat thereby determines the measuring surface on the closure member 22 that is effective for the pressure in the line 12. If the force exerted on the measuring surface by the pressure in the line 12 exceeds the pretension in the measuring spring set 17, the valve cone of the closure member lifts off from the valve seat in the valve body 25 and opens the control line 12 to the pressureless outlet formed by the interior 31 of the valve housing 21 that is fixed to the hydropump, whereby the interior 31 is connected with the pressureless interior 32 of the hydropump.

By the movement of the pump control member in the direction of reduced output, the follower pin 20 moves the valve body 25 in FIG. 2 to the right against the closure member 22 and thereby increases the pre-tension of the spring set 17 corresponding to the desired shape of the torque characteristic.

Figure 4:
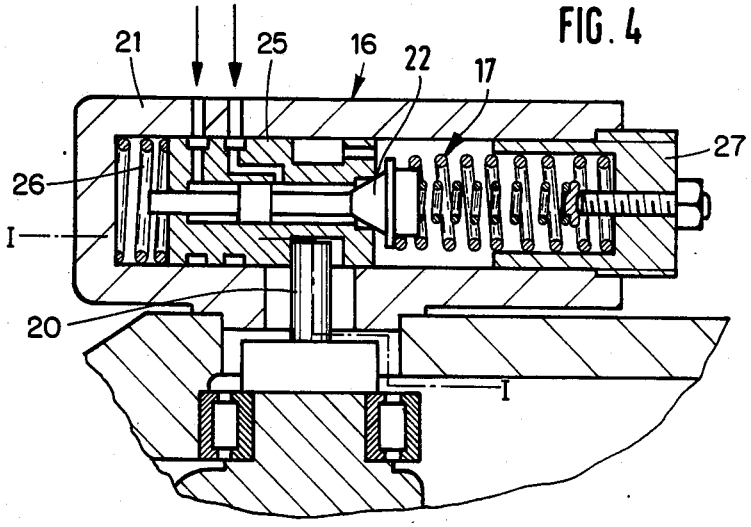
FIG. 4 shows diagrammatically in detail and on a larger scale the torque valve with a closure member with several measuring surfaces and FIG. 5 is a sectional view taken along line I—I in FIGS. 2 and 4.
Figure 3:
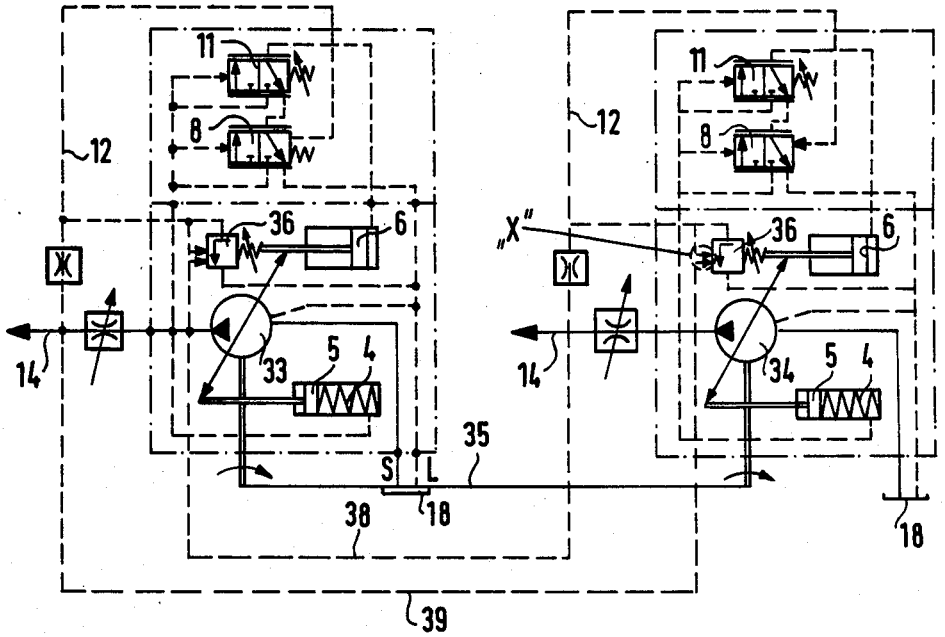
FIG. 3 shows diagrammatically control device according to the invention for two hydropumps coupled on the working side.

FIG. 3 shows the control device of the invention as a combined torque control for two hydropumps 33,34, whose drive shafts are driven directly or via a suitable distributor gear 35 (indicated merely diagrammatically by a line) by a common drive motor (not shown). The control devices for the individual pumps correspond to the control device in FIG. 1. Similar parts are given the same reference numerals and are not explained again. Only the torque valves indicated in FIG. 1 by 16 are here constructed as combination valve 36 and differ from the torque valve 16 in that the closure member 22 has an additional measuring surface 37, as shown in FIG. 4. The working pressure of the other pump acts in each case on this measuring surface 37 via a control line 38,39. The response, i.e. the opening of the torque valve 36 for the control pressure agent into the lines 12 to the pressureless outlet, results from the total of the working pressures. Such controls are for example necessary if the hydropumps are driven by a common drive shaft or through a distributor gear, and the total of the two take-up torques of the pumps must not exceed the drive torque.

We claim:

1. Torque control device for an adjustable hydropump having a hydraulic servo-mechanism for continuous adjustment of the pump output, a pump control member including a swash plate, in which an output setting for the pump is determined by the output pressure of the hydropump and a pressure in a working pressure control line, and in which an adjusting mechanism includes a spring urging the pump control member in the direction of maximum output and at least one piston of said hydraulic servo-mechanism acting on the pump control member in the direction of reduction in output, a piston face of said piston being exposed to the output pressure through a hydraulically operated control valve, or with a drain, and the control valve is operated by the pressure in the working pressure control line, characterized by the provision of a torque valve whose closure force is determined by the angle of said swash plate through a measuring spring or set of springs connected to the valve and a stop member and tensioned as a function of the output setting, and the working pressure control line is connected to the drain depending on the pressure in the working pressure control line and the tension in the measuring spring or springs.

2. Control device according to claim 1, characterized in that the pressure acting on the control valve and the torque valve or on closure members of each said valves is received in the working pressure control line as the pressure beyond a throttle in the control line branching off from the working pressure line of the pump, and an output throttle, which may be variable, is provided upstream of the branch in the control line.

3. Control device according to claim 2, characterized in that the torque valve is fixed on to the hydropump as a separate unit, and a follower pin on the swash plate of the pump control member engages the torque valve to alter the tension in the measuring spring or springs, depending on the output setting.

4. Control device according to claim 1, characterized in that the torque valve is fixed on to the hydropump as a separate unit, and a follower pin on the swash plate of the pump control member engages the torque valve to alter the tension in the measuring spring or springs, depending on the output setting.

5. Control device according to claim 4, characterized in that the torque valve is in the form of a valve seat having a valve cone constituting the closure member is acted upon by the measuring spring or set of springs, which is or are supported on the other side by an adjustable stop in a valve housing for said valve, and wherein the valve seat is arranged in a displaceable valve body which is engaged by the follower pin.

6. Control device according to claim 5, characterized in that the valve body is loaded by a spring that holds it closely up against the follower pin.

7. Control device according to claim 4, characterized in that the stop is arranged on a front surface of the valve housing and can be released to exchange the measuring spring or set of springs.

8. Control device according to claim 5, characterized in that the stop for the measuring spring or set of springs is adjustable from outside by means of a hand control.

9. Control device according to claim 8, characterized in that the stop is arranged on a front surface of the valve housing and can be released to exchange the measuring spring or set of springs.

* * * * *